US008010024B2

(12) United States Patent
Yamada et al.

(10) Patent No.: US 8,010,024 B2
(45) Date of Patent: Aug. 30, 2011

(54) DEVELOPER APPARATUS WITH RESTRICTION MEMBER REMOVING TONER FROM CONVEX SECTIONS OF TONER CARRIER ROLLER

(75) Inventors: Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 361 days.

(21) Appl. No.: 12/254,190

(22) Filed: Oct. 20, 2008

(65) Prior Publication Data

US 2009/0110444 A1 Apr. 30, 2009

(30) Foreign Application Priority Data

Oct. 29, 2007 (JP) ..... 2007-279841

(51) Int. Cl.
*G03G 15/08* (2006.01)
*G03G 15/095* (2006.01)

(52) U.S. Cl. ..... 399/284; 399/264; 399/265; 399/283; 399/286

(58) Field of Classification Search ..... 399/276, 399/284
See application file for complete search history.

(56) References Cited

U.S. PATENT DOCUMENTS 5,412,456 A * 5/1995 Tanuma et al. ..... 399/284
5,604,074 A * 2/1997 Yasuda et al. ..... 430/123.54
2007/0110481 A1 5/2007 Yamada et al.
2007/0110484 A1* 5/2007 Yamada et al. ..... 399/286
2008/0273901 A1* 11/2008 Toyama et al. ..... 399/286
2008/0298855 A1 12/2008 Yamada et al.

FOREIGN PATENT DOCUMENTS

JP 63199382 A * 8/1988
JP 2001134069 A 5/2001
JP 2007-121948 A 5/2007
JP 2007-121949 A 5/2007
JP 2007-140080 A 6/2007
JP 2007147853 A 6/2007
JP 2007199424 A 8/2007
JP 2008299013 A 12/2008

OTHER PUBLICATIONS

European search report for corresponding European application 08018814.7-2209 lists the references above.

* cited by examiner

*Primary Examiner* — David Gray
*Assistant Examiner* — David Bolduc
(74) *Attorney, Agent, or Firm* — DLA Piper LLP (US)

(57) ABSTRACT

A developer apparatus includes a toner carrier roller having convex and concave sections formed thereon. A restriction member including an elastic abutting member having an edge part that abuts the toner carrier roller removes toner from the convex sections such that the concave sections alone carry toner. Within a restriction nip created as the toner carrier roller and the restriction member abut abutting segments where the edge part abuts on the convex sections, and opening segments where the edge part and the concave sections are opposed to each other with a gap between each other, appear alternatingly along the width direction. In the opening segments, the edge part bulges toward bottom surfaces of the concave sections beyond linear lines connecting top surfaces of two adjacent convex sections which are on both sides to the concave sections which are opposed to the edge part.

13 Claims, 13 Drawing Sheets

FIG. 6A
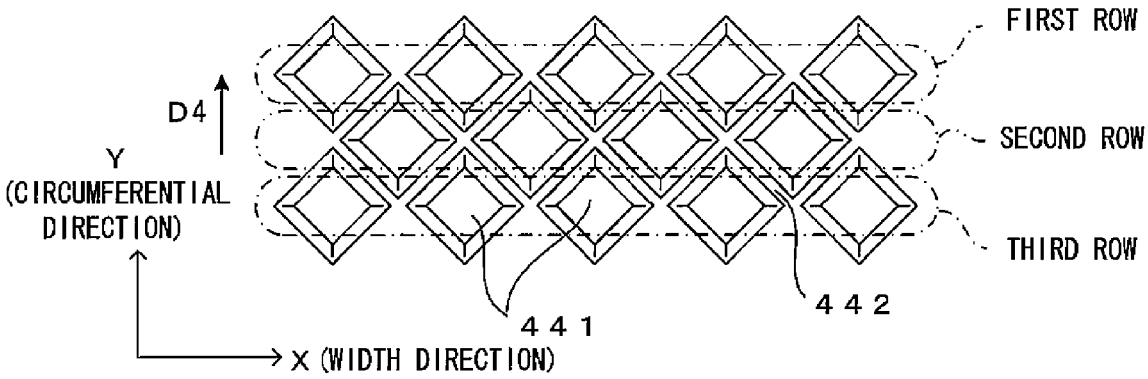
FIG. 6B
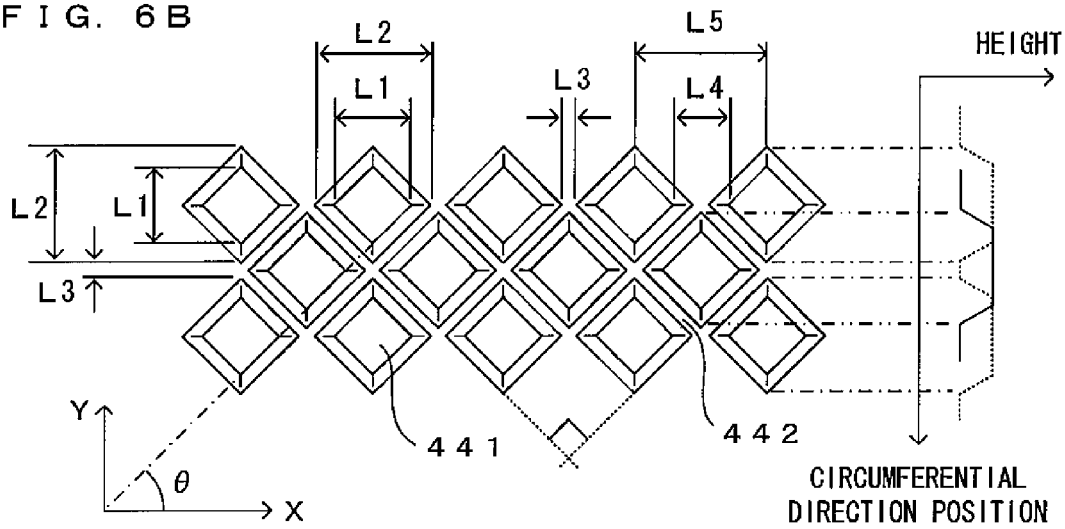
FIG. 6C
| SYMBOL | CALCULATING FORMULA | NUMERIC EXAMPLE |
|---|---|---|
| L1 | — | 80 μm |
| L2 | — | 100 μm |
| L3 | — | 20 μm |
| L4 | L2−L1+L3 | 40 μm |
| L5 | L2+L3 | 120 μm |
| θ | — | 45° |

FIG. 13

| HARDNESS (JIS-A) | RESTRICTION LOAD [gf/mm] | GAP L4 BETWEEN CONVEX SECTIONS [μm] | | |
|---|---|---|---|---|
| | | 150 | 100 | 50 |
| 65 DEGREES | 0.2 | ○ | ○ | — |
| | 0.5 | ○ | ○ | ○ |
| | 0.9 | ○ | ○ | ○ |
| | 1.2 | ○ | ○ | ○ |
| | 1.5 | ○ | ○ | ○ |
| | 1.9 | × | × | × |
| | 2.2 | × | × | × |
| | 2.5 | × | × | × |
| | 2.8 | × | × | × |
| | 3.2 | × | × | × |
| 70 DEGREES | 0.2 | ○ | ○ | — |
| | 0.5 | ○ | ○ | ○ |
| | 0.9 | ○ | ○ | ○ |
| | 1.2 | ○ | ○ | ○ |
| | 1.5 | ○ | ○ | ○ |
| | 1.9 | × | ○ | ○ |
| | 2.2 | × | × | × |
| | 2.5 | × | × | × |
| | 2.8 | × | × | × |
| | 3.2 | × | × | × |
| 80 DEGREES | 0.2 | — | — | — |
| | 0.5 | ○ | ○ | ○ |
| | 0.9 | ○ | ○ | ○ |
| | 1.2 | ○ | ○ | ○ |
| | 1.5 | ○ | ○ | ○ |
| | 1.9 | ○ | ○ | ○ |
| | 2.2 | × | ○ | ○ |
| | 2.5 | × | × | × |
| | 2.8 | × | × | × |
| | 3.2 | × | × | × |
| 83 DEGREES | 0.2 | — | — | — |
| | 0.5 | — | — | — |
| | 0.9 | ○ | — | — |
| | 1.2 | ○ | ○ | ○ |
| | 1.5 | ○ | ○ | ○ |
| | 1.9 | ○ | ○ | ○ |
| | 2.2 | ○ | ○ | ○ |
| | 2.5 | × | × | ○ |
| | 2.8 | × | × | × |
| | 3.2 | × | × | × |

DEVELOPER APPARATUS WITH RESTRICTION MEMBER REMOVING TONER FROM CONVEX SECTIONS OF TONER CARRIER ROLLER

CROSS REFERENCE TO RELATED APPLICATION

The disclosure of Japanese Patent Application No. 2007-279841 filed on Oct. 29, 2007 including specification, drawings and claims is incorporated herein by reference in its entirety.

BACKGROUND

1. Technical Field

The present invention relates to a developer apparatus which comprises a toner carrier roller whose surface carries toner, and an image forming apparatus for and an image forming method of developing an electrostatic latent image with toner using this roller.

2. Related Art

In techniques for developing an electrostatic latent image carried on an image carrier with toner, an apparatus is widely used which includes a toner carrier roller which is shaped approximately like a cylinder, carries toner on a surface thereof, and is arranged opposed facing the image carrier. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-121949). Since the concavo-convex patterns in the surface are regulated and uniform, such a structure is advantageous in that it permits easy control of the thickness of a toner layer which is carried on the surface of the roller, the charge level and the like.

In an image forming apparatus having the structure above, for the purpose of restricting the thickness of a toner layer carried by the convex and the concave sections formed in the toner carrier roller to a predetermined thickness, a layer thickness restricting member (restriction blade) abuts on the toner layer which is on the surface of the toner carrier roller.

SUMMARY

However, in the case where a toner carrier roller having the structure above is used, owing to the evenness of the convexo-concave, scattering of toner from the surface of the toner carrier roller, fog and the like will be a problem unless a toner layer thickness on the toner carrier roller is strictly controlled. Particularly when toner becomes compressed powder due to the pressing force from the restriction blade, the toner gathers together as large aggregations or clusters of an additive, wax and the like falling off from the toner serve as cores around which even larger toner aggregations are created. They may leak out to outside a developer and get scattered or may adhere to an image carried on the image carrier and cause fog. Further, toner aggregations thus created may fixedly adhere to the toner carrier roller, thereby resulting in filming, image defects, etc.

An advantage of some aspects of the invention is to provide technology for preventing problems such as leakage and scattering of toner and fog attributable to creation of toner aggregations in a developer apparatus, an image forming apparatus and an image forming method which use a toner carrier roller whose surface is provided with convexoconcave.

According to a first aspect of the invention, there is provided a developer apparatus, comprising: a toner carrier roller which rotates while carrying a toner layer of charged toner on its surface, the toner carrier being shaped approximately like a cylinder and being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections; and a restriction member which abuts on the surface of the toner carrier roller, thereby restricting the toner layers which are carried on the surface of the toner carrier roller, the restriction member including an elastic abutting member formed by an elastic material, the elastic abutting member which includes an edge part which extends along the width direction parallel to the rotation shaft of the toner carrier roller and abuts on the surface of the toner carrier roller, wherein within a restriction nip which is created as the toner carrier roller and the restriction member abut on each other, a plurality of abutting segments where the edge part abuts on the plurality of convex sections and opening segments where the edge part and the concave sections are opposed each other with a gap between each other appear alternately along the width direction, and in the opening segments, the edge part of the elastic abutting member bulges toward bottom of the concave sections beyond linear lines which connect top surfaces of two adjacent convex sections which are on both sides to the concave sections which are opposed to the edge part.

According to a second aspect of the invention, there is provided an image forming apparatus, comprising: an image carrier which carries an electrostatic latent image; a toner carrier roller which is opposed to the image carrier and rotates while carrying a toner layer of charged toner on its surface, the toner carrier being shaped approximately like a cylinder and being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections; and a restriction member which abuts on the surface of the toner carrier roller, thereby restricting the toner layers which are carried on the surface of the toner carrier roller, the restriction member including an elastic abutting member formed by an elastic material, the elastic abutting member which includes an edge part which extends along the width direction parallel to the rotation shaft of the toner carrier roller and abuts on the surface of the toner carrier roller, wherein within a restriction nip which is created as the toner carrier roller and the restriction member abut on each other, a plurality of abutting segments where the edge part abuts on the plurality of convex sections and opening segments where the edge part and the concave sections are opposed each other with a gap between each other appear alternately along the width direction, and in the opening segments, the edge part of the elastic abutting member bulges toward bottom of the concave sections beyond linear lines which connect top surfaces of two adjacent convex sections which are on both sides to the concave sections which are opposed to the edge part.

According to a third aspect of the invention, there is provided an image forming method comprising: arranging a toner carrier roller oppositely to an image carrier which carries an electrostatic latent image, the toner carrier roller being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections, and rotating while carrying on its surface a toner layer of charged toner; abutting a restriction member which includes an elastic abutting member formed by an elastic material, the elastic abutting member including an edge part which extends along the width direction parallel to the rotation shaft of the toner carrier roller and abuts on the surface of the toner carrier roller; and developing the electrostatic image with the toner carried on the toner carrier roller, wherein a plurality of abutting segments where the edge part abuts on the plurality of convex sections and opening segments where the edge part and the concave sections are opposed each other with a gap between each other appear alternately along the width direction, and at the opening segments, the edge part of the elastic abutting member bulges toward bottom of the concave sections beyond linear lines which connect top surfaces of two adjacent convex sections which are on both sides to the concave sections which are opposed to the edge part.

In the invention structured above, the edge part of the elastic abutting member abuts on the convex sections in the surface of the toner carrier roller, thereby creating a gap between the concave sections and the edge part. This makes the concave sections alone carry toner and prevents carrying of toner by the convex sections The restriction member therefore never presses toner at the convex sections, which suppresses creation of toner aggregations due to pressing by the restriction.

Pressed against the plurality of convex sections which are regularly arranged in the width direction, the edge part is elastically deformed at these sections. Meanwhile, the amount of deformation within the concave sections which are between the convex sections is different: the edge part of the elastic abutting member bends locally and is deformed in a saw-tooth form. Since the convex sections are regularly arranged in the circumferential direction of the toner carrier roller as well, as the toner carrier roller rotates, segments within the edge part of the elastic abutting member each repeatedly expand and shrink along the direction of the diameter of the toner carrier roller. In short, in the structure above, the edge part of the elastic abutting member ripples and vibrates as the toner carrier roller rotates. The edge part opposed against the concave sections, when formed to bulge toward the bottom of the concave sections, provides vibrations which strike toner carried by the concave sections.

Although mere application of pressing force upon toner carried by the concave sections could flocculate toner or press toner against and fixedly adhere toner to the surface of the toner carrier roller, since the edge part vibrates while alternately applying and mitigating pressing force upon the concave sections according to the above structure, it is possible to crush toner aggregations which are at or around the concave sections. This was confirmed through experiments as described later. Destruction of toner aggregations at an early stage achieved according to the invention makes it possible to prevent growth of larger toner aggregations and hence associated leakage, scattering, fog, filming, etc. In addition, stimulation of toner at or near the concave sections attains an effect of increasing the fluidity of the toner and improving the uniformity of a toner layer.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 6A and 6B are plan development views showing the structure of the surface of the developing roller in further detail, and FIG. 6C is a table showing an example of a calculating formula.

FIG. 13 is a table showing combinations of the hardness of the elastic member, the restriction load and the gap between the convex sections.

DESCRIPTION OF EXEMPLARY EMBODIMENTS

Figure 1:
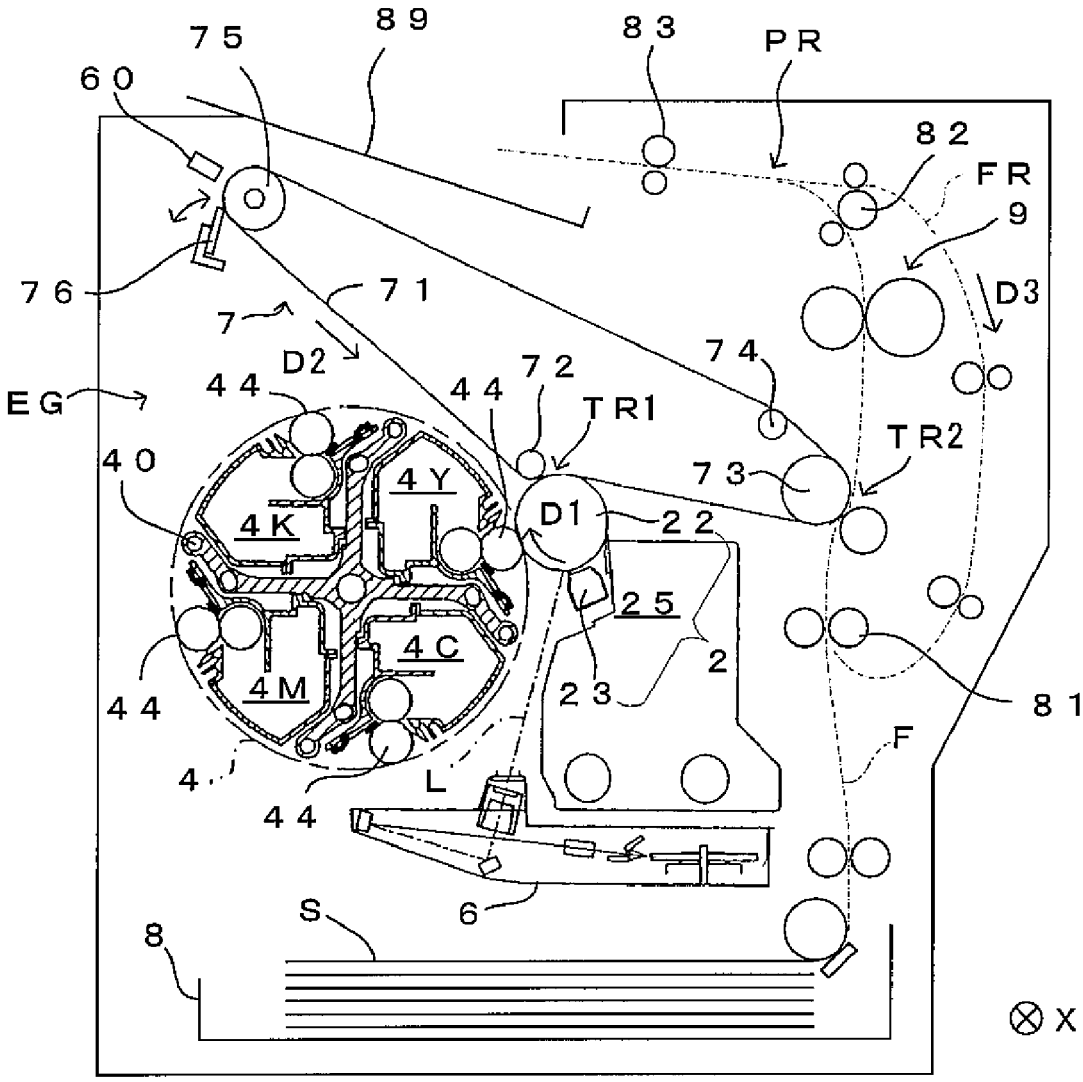
FIG. 1 is a diagram showing an embodiment of an image forming apparatus according to the invention.
Figure 2:
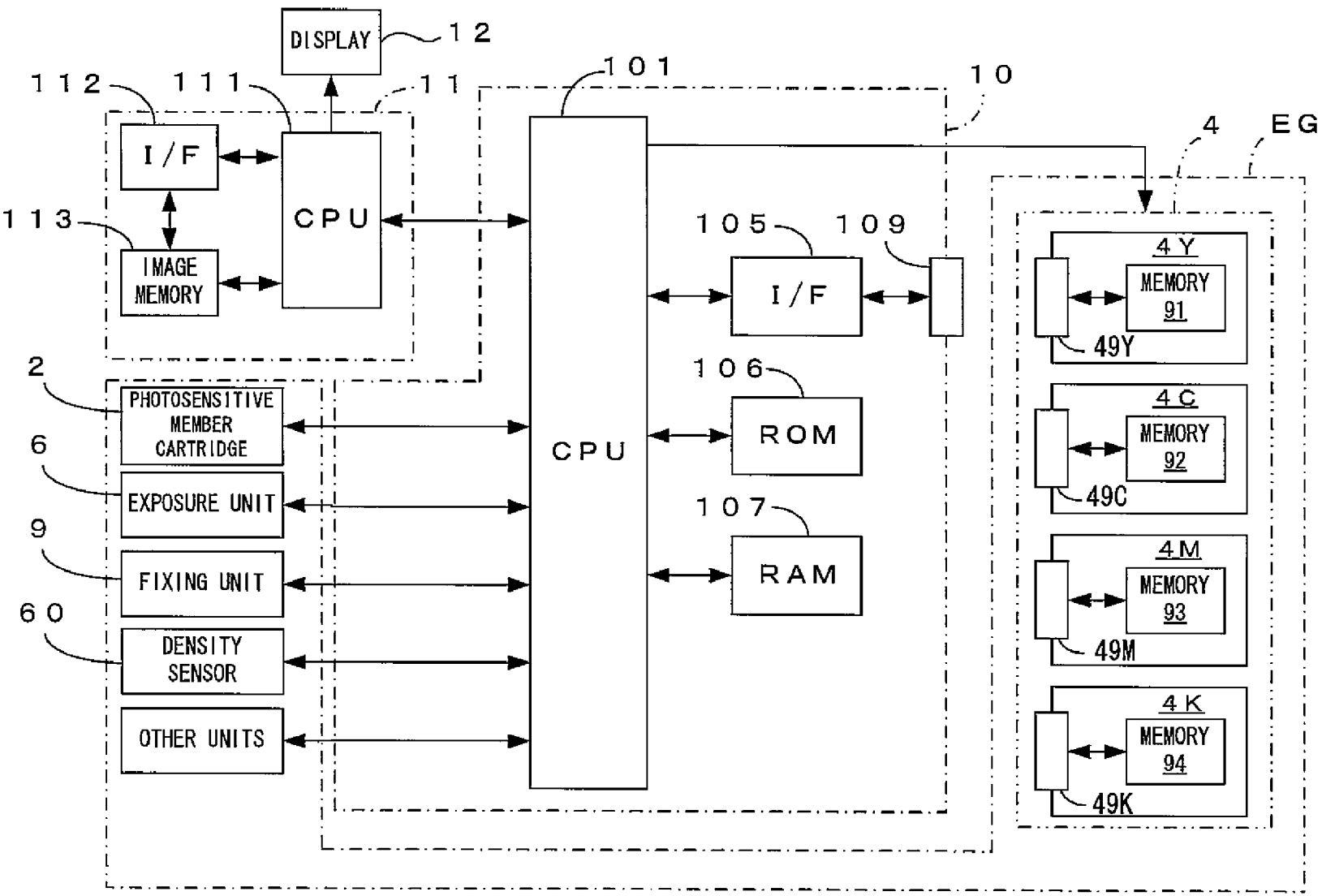
FIG. 2 is a block diagram of an electric structure of the image forming apparatus which is shown in FIG. 1.

FIG. 1 is a diagram showing an embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
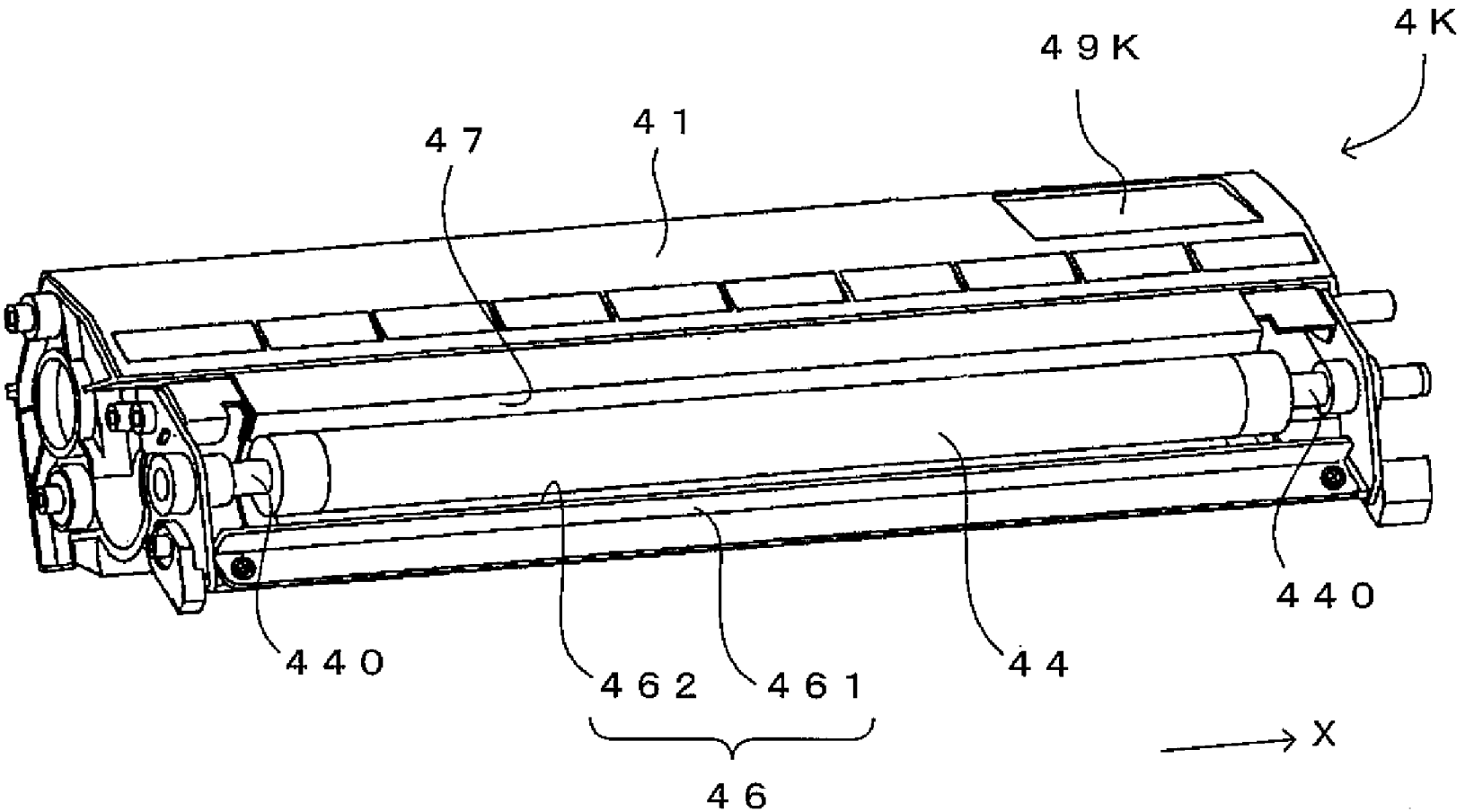
FIG. 3 is a diagram showing the appearance of the developer.
Figure 4A:
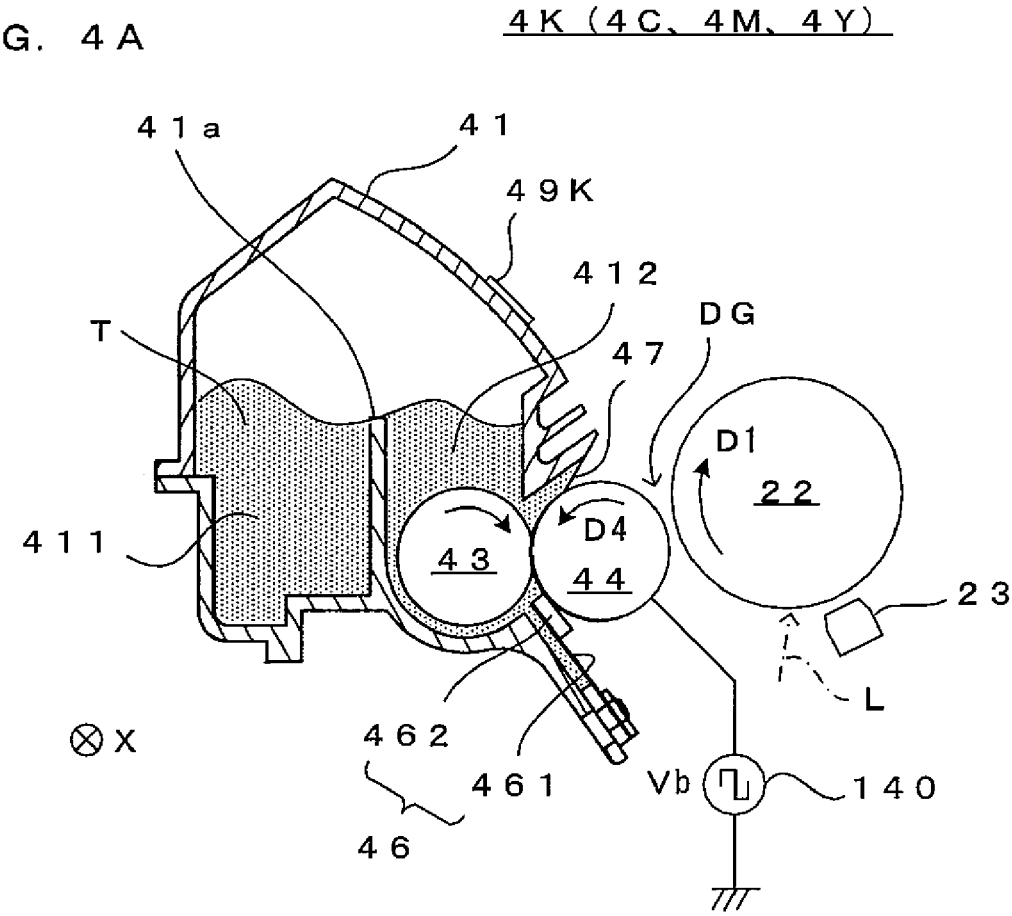
FIG. 4A is a cross sectional view showing a structure of the developer.
Figure 4B:
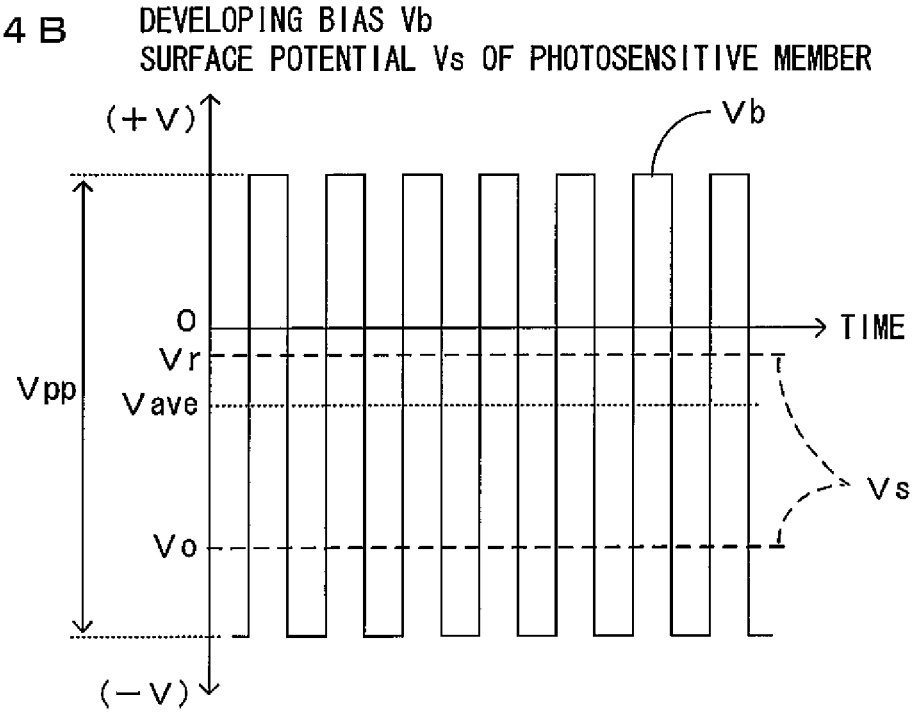
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential V0 at non-exposed segments not exposed by the light beam L. Meanwhile, the developing bias Vb applied to the developing roller 44 is rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

A rectangular-wave voltage having a peak-to-peak voltage Vpp of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible material such as polyethylene, nylon or fluororesin extending in a direction X parallel to a rotational axis of the developing roller 44. One end of the seal member 47 in a direction perpendicular to the direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside.

Figure 5:
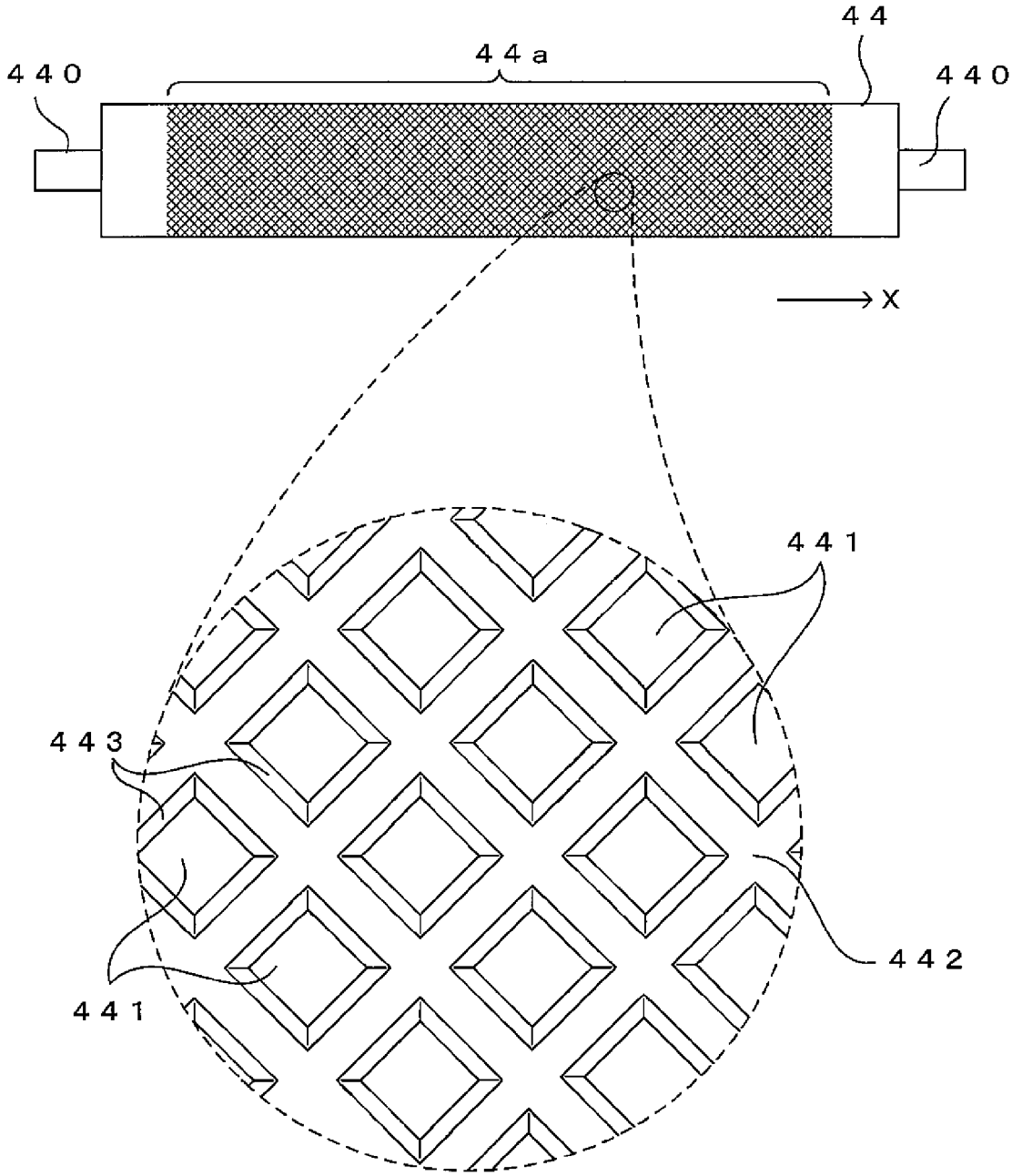
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotation shaft of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotation shaft of the developing roller 44. Moderate slopes 443 connect the convex sections 441 to the concave sections 442 which surround the convex sections 441. That is, a normal line to the slopes 443 contains a component which is outward along the radius direction of the developing roller 44 (upward in FIG. 5), i.e., which is along a direction away from the rotation shaft of the developing roller 44. The developing roller 44 having such a structure may be made by the manufacturing method described in JP-A-2007-140080 for instance.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as the developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this embodiment, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure in this embodiment meets the demand. Small-particle toner generally has a high saturation charge level but gets charged slowly at the beginning, and hence, toner carried by the convex sections 441 tends to have a significantly higher charge level (get excessively charged) than toner carried by the concave sections 442. A charge level difference thus created shows itself as a development history in an image. Further, with respect to toner having a low melting point, fixing of toner to each other and fixing of the toner to the developing roller 44 and the like could easily occur by the friction contact of toner with each other or with the developing roller 44. However, such a problem is less likely to occur where the structure according to the embodiment is used in which only the concave sections 442 carry toner.

FIGS. 6A and 6B are plan development views showing the structure of the surface of the developing roller in further detail. Each one of the convex sections 441 in the surface of the developing roller 44 has a top section which is shaped like an approximately square projection rotated 45 degrees as shown in FIG. 6A. A number of such convex sections 441 are arranged linearly at equal intervals along a width direction X which is parallel to the rotation shaft of the developing roller 44, thereby constituting convex section rows. A plurality of convex section rows are provided also along a circumferential direction Y, which is orthogonal to the width direction X, yet at different positions on the circumferential surface of the developing roller 44. FIG. 6A shows three convex section rows, which will be hereinafter referred to as "the first row", "the second row" and "the third row" from the top in FIG. 6A.

As shown in FIG. 6B, the angle of the ridge line of each convex section 441 with respect to the width direction X is denoted at θ. As for the dimensions of each part, the symbol L1 denotes the length of a diagonal line within the top section of each convex section 441, the symbol L2 denotes the length of a diagonal line within the bottom section of each convex section 441, the symbol L3 denotes the gap between the bottom sections of two convex sections 441 which are adjacent to each other along the width direction X and the circumferential direction Y, the symbol L4 denotes the gap between two convex sections 441 which are adjacent to each other along the width direction X and the circumferential direction Y, and the symbol L5 denotes the pitch at which the convex sections 441 are arranged along the width direction X and the circumferential direction Y These can not be always set independently of each other: for example, in the case of a roller which is formed by a rolling method which requires rotating a metallic cylinder which is kept in contact with a die as described in JP-A-2007-140080, when some of these values are determined, the other values are automatically determined by calculation. FIG. 6C is table showing an example of a calculating formula. Although FIG. 6C also shows an example of representative values, the values in FIG. 6C are not limiting.

As shown in FIG. 6A, the locations of the convex sections 441 along the width direction X are shifted half the pitch L5 of the convex sections 441 from each other between the first and the second rows. This holds true as for the locations between the second and the third rows as well. That is, the convex section rows are arranged such that the convex sections 441 are in a staggered pattern in the surface of the developing roller 44. The surface of the developing roller 44 therefore looks as if it seats rows of the convex sections which are arranged in an oblique direction which is at 45 degrees with respect to the width direction X. The convex sections 441 are at the same height as shown in a far-right area in FIG. 6B.

Figure 7:
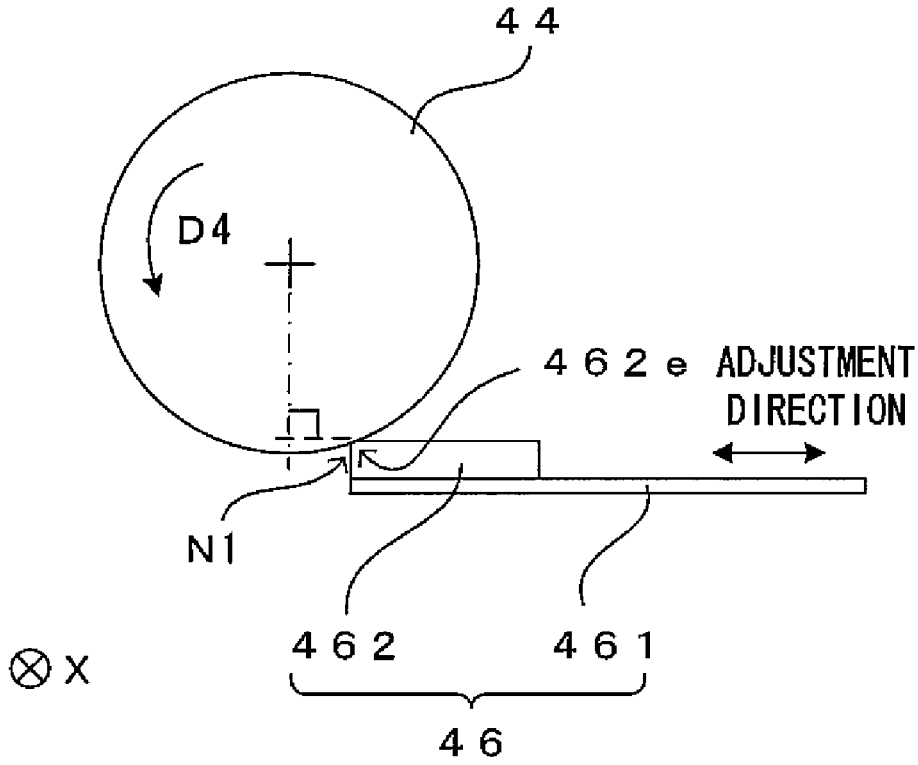
FIG. 7 is a diagram showing a condition of the developing roller and the restriction blade abutting on each other.

FIG. 7 is a diagram showing a condition of the developing roller and the restriction blade abutting on each other. In this embodiment, as shown in FIG. 7, the restriction blade 46 abuts on the surface of the developing roller 44 in a direction against the rotation direction D4 of the developing roller 44, or directed in a so-called counter direction. The elastic member 462 at the tip end of the restriction blade 46 gets pressed by the surface of the developing roller 44 and partially and elastically deformed, whereby a restriction nip N1 is formed in which the surface of the developing roller 44 contacts the elastic member 462. Further, an upper edge of an upstream-side end 462*e* of the elastic member 462 in the rotation direction D4 of the developing roller 44 is within the restriction nip N1, and toner is restricted by means of the edge restriction.

Along the rotation direction D4 of the developing roller 44, the upstream-side end of the elastic member 462 is on the downstream side to a perpendicular line (dashed line) dropped to the top surface of the elastic member 462 from the center of rotation of the developing roller 44. Hence, the amount of deformation of the elastic member 462 due to elastic deformation near the upstream-side end is maximum at the edge part 462*e* but decreases toward the downstream side. The width of the restriction nip N1 and the abutting pressure from the elastic member 462 upon the surface of the developing roller 44 can be controlled through adjustment of the position of the restriction blade 46 along an adjustment direction denoted at an arrow in FIG. 7.

Figure 8A:
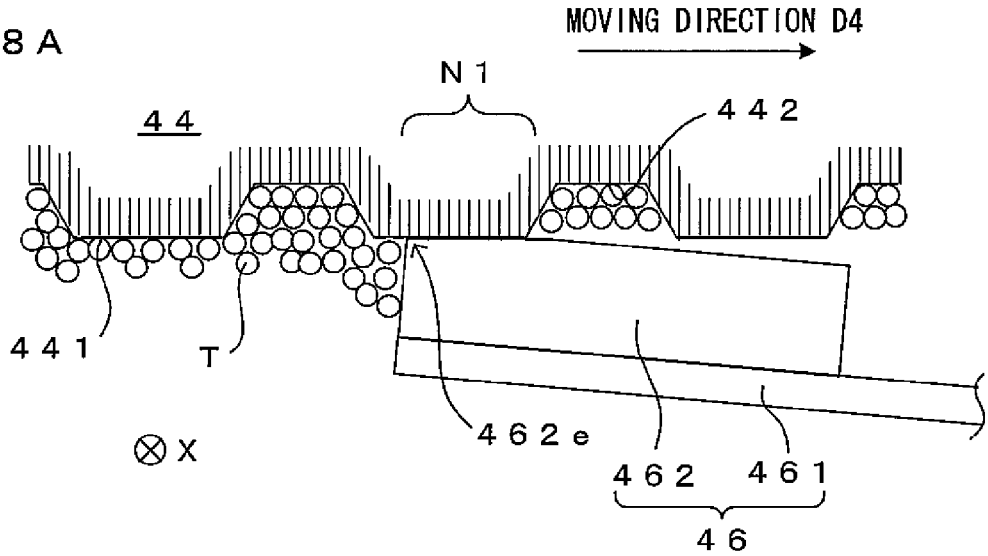
FIGS. 8A and 8B are enlarged schematic views of the cross section of the restriction nip.
Figure 8B:
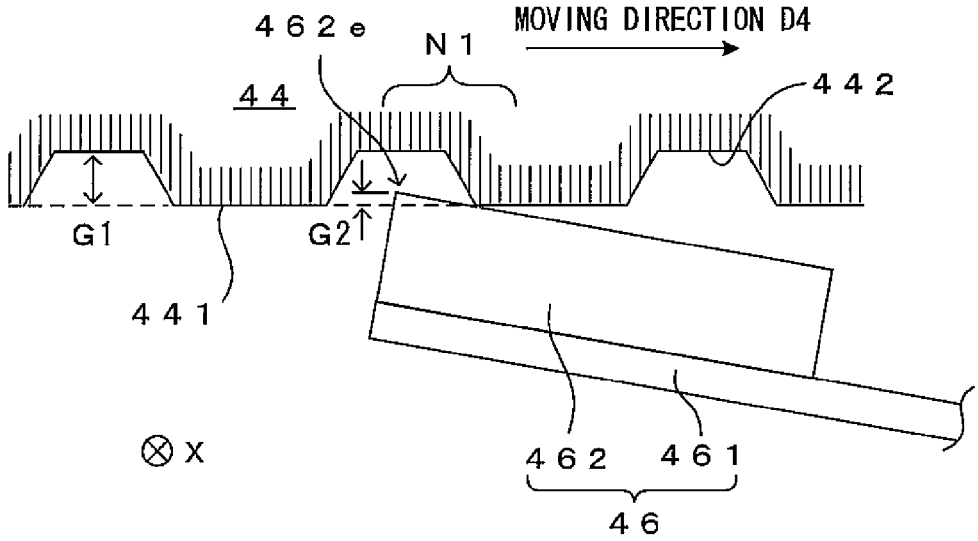

FIGS. 8A and 8B are enlarged schematic views of the cross section of the restriction nip. Toner is restricted within the restriction nip N1 in the following manner. As shown in FIG. 8A, the elastic member 462 of the restriction blade 46 is pressed against the surface of the developing roller 44, more particularly against the convex sections 441 of the developing roller 44, whereby the restriction nip N1 is created. The edge 462*e* of the elastic member 462 abuts on the convex sections 441 of the developing roller 44 within the restriction nip N1, and the elastic member 462 is elastically deformed and bent in the vicinity of the convex sections. In the surface of the developing roller 44 on the upstream side to the restriction nip N1 along the rotation direction D4 of the developing roller 44 (i.e., on the left-hand side in FIG. 8A), multiple layers of toner are present which have been rubbed against and adhered to both the convex sections 441 and the concave sections 442 by the feed roller 43. Of the toner, the elastic member 462 scrapes off a volume of toner carried by the convex sections 441, and within the restriction nip N1 on the downstream side to the restriction nip N1 (i.e., on the right-hand side in FIG. 8A), only the concave sections 442 carry toner.

While toner carried on the surface of the developing roller 44 on the upstream side to the restriction nip N1 could contain both favorably charged toner and poorly charged toner, as a result of toner layer restriction by the restriction blade 46, toner having a high charge level and strongly adhering to the developing roller 44 stays within the concave sections 442, whereas toner having a low charge level, pushed away by the toner having the high charge level, is unlikely to remain in the concave sections 442. Toner carried by the concave sections 442 on the downstream side to the restriction nip N1 is therefore mostly favorably charged toner.

Meanwhile, since the convex sections 441 are in a staggered arrangement as shown in FIG. 6A, at a position which is different from the position shown in FIG. 8A by half the pitch L5 along the width direction X, the edge 462*e* of the elastic member 462 is opposed against the concave sections 442 of the developing roller 44 as shown in FIG. 8B. As there is a gap between the edge 462*e* of the elastic member 462 and the surface of the developing roller 44 at this position, the elastic member 462 does not get elastically deformed or gets deformed only slightly under the influence of deformation nearby. In addition, since the elastic member 462 is pressed against the developing roller 44, the edge 462*e* of the elastic member 462 intrudes into inside the concave sections 442 beyond linear lines which are denoted at the dashed lines in FIG. 8B and connect the top surfaces of adjacent convex sections 441 and the edge 462*e* bulges toward the bottom of the concave sections 442. In other words, considering an imaginary cylindrical surface containing the top surfaces of the convex sections 441, the edge 462*e* moves into inside the imaginary cylindrical surface at the concave sections 442.

The developing roller 44 rotates in the arrow direction D4 at the position shown in FIG. 8A as well, and therefore, the edge 462*e* of the elastic member 462 bulges toward the concave sections 442 as shown in FIG. 8B in a predetermined period of time from its state shown in FIG. 8A. Thus bulging edge 462*e* may press toner carried by and around the concave sections 442. For prevention of an adverse influence of this, the height difference G1 between the convex sections 441 and the concave sections 442 of the developing roller 44 and the amount of bulging G2 of the elastic member 462 toward the concave sections 442 are defined as follows.

The height difference G1 between the convex sections 441 and the concave sections 442 of the developing roller 44, in light of the necessity of carrying one or more layers of toner, is ideally equal to or larger than the volume average particle diameter Dave of toner T. In short, it is desirable the height difference satisfies the relationship below:

$$G1 \geqq Dave \qquad \text{(Formula 1)}$$

In the meantime, considering variations of a toner particle diameter, the distance G1 between the convex sections 441 and the concave section 442 may be equal to or larger than the diameter of the largest toner particles among toner T. The maximum particle diameter of toner can be defined as described below in accordance with statistics. That is, the maximum particle diameter Dm can be defined by the following formula:

$$Dm = D50 + 3\sigma \qquad \text{(Formula 2)}$$

where the symbol D50 denotes the 50% particle diameter at the quantity standard of toner T and the symbol σ denotes the geometrical standard deviation. In toner which is normally used, the proportion of toner whose particle diameter exceeds the maximum particle diameter Dm is extremely small. When the distance G1 is small, toner having a large particle diameter could stay indefinitely within the developer without getting fed to the concave section 442 so that the particle diameter distribution of toner will gradually shift toward the large diameter side to the extent not usable for development. When the distance G1 is equal to or larger than the maximum particle diameter Dm, the concave section 442 can carry almost all toner particles contained in toner T held inside the developer, which makes it possible to use all toner inside the developer to the very end. That is, the following formula needs be satisfied:

$$G1 \geqq Dm = D50 + 3\sigma \qquad \text{(Formula 3)}$$

Meanwhile, as for the amount of bulging of the edge 462*e* of the elastic member 462, if the amount is too large, the edge 462*e* pushes out toner which is inside the concave sections 442, the transported toner amount decreases and the pressing force upon toner grows. When the amount of bulging G2 is larger than the volume average particle diameter Dave of toner, toner equivalent to one layer is scraped out from toner carried by the concave sections 442. Noting this, the relationship below may be satisfied so as not to scrape toner out:

$$G2 \leqq Dave \quad \text{(Formula 4)}$$

FIGS. 9A, 9B, 9C and 9D are diagrams of the restriction nip as it is viewed along the width direction. In the event that the edge 462*e* of the elastic member 462 stays abutting on the developing roller 44 along A-A shown in FIG. 9A for instance, areas of the elastic member 462 abutting on the convex sections 441 which belong to the second row get elastically deformed, whereas areas opposed against the concave sections 442 bulge toward the concave sections 442 as shown in the A-A cross sectional view in FIG. 9B. In this fashion, when viewed in the width direction (the X-direction), the edge 462*e* of the elastic member 462 has a waving shape in which the sunk areas abutting on the convex sections 441 (the positions Pc for instance) and the areas creating gaps with the concave sections 442 and bulging toward the concave sections 442 (the positions Pa for instance) alternately appear.

Figure 9A:
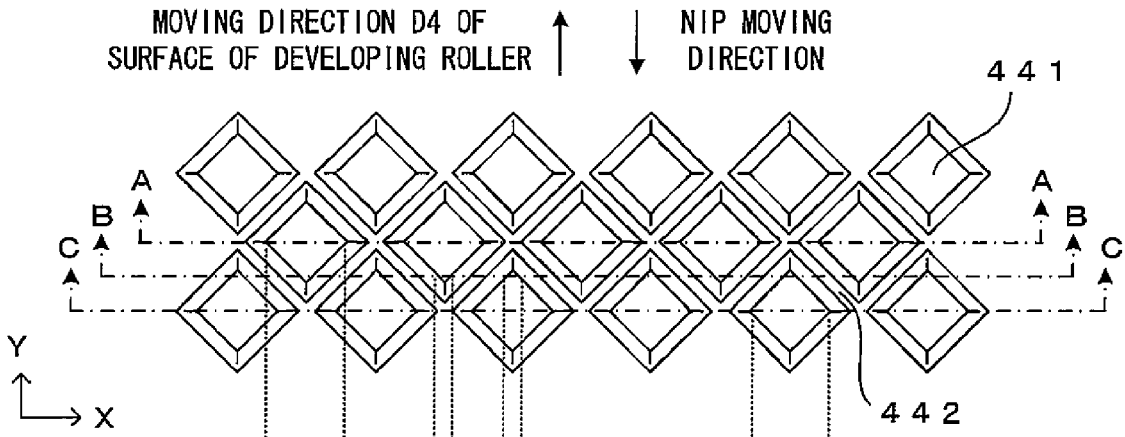
FIGS. 9A, 9B, 9C and 9D are diagrams of the restriction nip as it is viewed along the width direction.
Figure 9B:
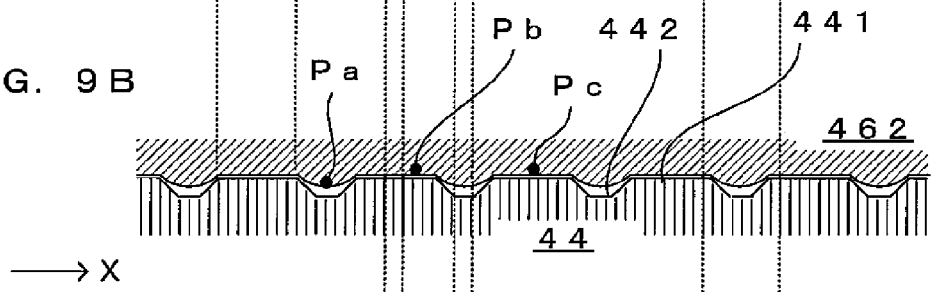

As the surface of the developing roller 44 moves along its rotation direction D4 (upward in FIG. 9A), the restriction nip where the edge 462*e* abuts on the surface of the developing roller 44 moves in the opposite direction (downward in FIG. 9A). Arriving at B-B shown in FIG. 9A, the edge 462*e* abuts on both the convex sections belonging to the second row and the convex sections belonging to the third row, and therefore, the edge becomes waving more finely at smaller pitches and positions Pb on the edge 462*e*, which correspond to positions off the center lines of the convex sections 441 along the width direction X, as well bulge toward the concave sections 442 as shown in the B-B cross sectional view in FIG. 9C.

As the edge 462*e* further moves to C-C shown in FIG. 9A, the positions Pc which used to abut on the convex sections 441 and sink become opposed against the concave sections 442, thereby decreasing the amount of deformation, whereas the positions Pa which used to be opposed against the concave sections 442 abut on the convex sections 441 and sink. In this manner, the respective areas in the edge 462*e* repeatedly abut on and leave the surface of the developing roller 44 as the developing roller 44 rotates, and cyclically wind up and down. Noting how they abut on the convex sections 441, areas in the edge 462*e* which abut on the convex sections 441 of the developing roller 44 are not fixed: different areas abut on the convex sections one after another as the developing roller 44 rotates.

Figure 9C:
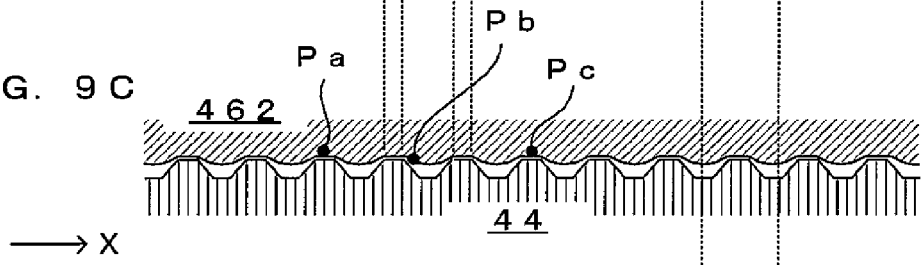
Figure 9D:
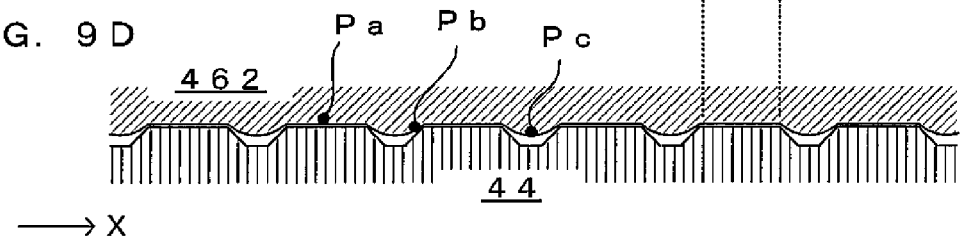
Figure 10:
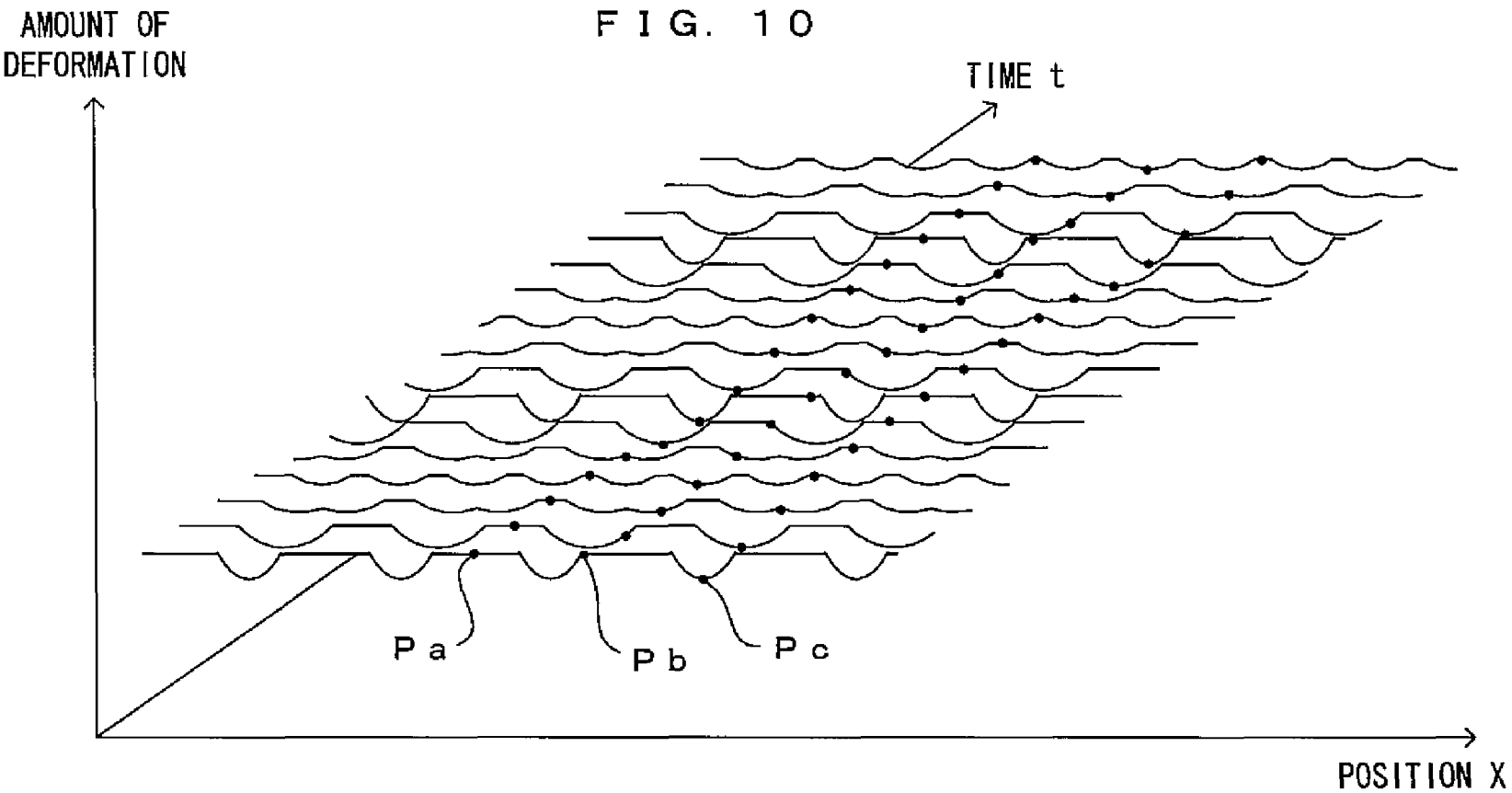
FIG. 10 is a diagram showing how the respective areas in the edge of the elastic abutting member move.

FIG. 10 is a diagram showing how the respective areas in the edge of the elastic abutting member move. In FIG. 10, the footprints of the positions Pa, Pb and Pc shown in FIG. 9B, 9C and 9D in particular are denoted at the circles. As shown in FIG. 10, the amounts of deformation of the respective areas in the edge 462*e* of the elastic member 462 keep changing in accordance with rotation of the developing roller 44. The edge 462*e* as a whole therefore moves as if to wave. While the respective areas move simply up and down as they abut on and leave the convex sections 441, since this embodiment requires that the top surfaces of the convex sections belonging to the respective convex section rows overlap with each other when taken in cross section along the circumferential direction as shown in the far-right area in FIG. 6B, there are moments in which the edge 462*e* abuts on both the convex sections belonging to each one of two adjacent convex section rows as denoted at B-B in FIG. 9A and as shown in FIG. 9C. The edge 462*e* therefore moves in a complex fashion while undulating as shown in FIG. 10. Particularly when areas which used to abut on the convex sections 441 stops abutting on the convex sections 441 as the convex sections 441 move, since elastic energy which has been building up due to elastic deformation is released all at once and the edge 462*e* which used to bend moves as if to jump back toward the concave sections 442 with great force.

As the edge 462*e* of the elastic member 462 waves in accordance with rotation of the developing roller 44, at the upstream-side end of the restriction nip N1 along the rotation direction D4 of the developing roller 44, the vibrating edge 462*e* of the elastic member 462 strikes toner carried by and around the concave sections 442. The striking force merely makes toner flow inside the concave sections 442 when the toner has a small particle diameter and is highly fluid. Upon toner aggregations having large particle diameters resulting from flocculation of toner, the striking force from the edge 462*e* acts to crush the aggregations.

Figure 11:
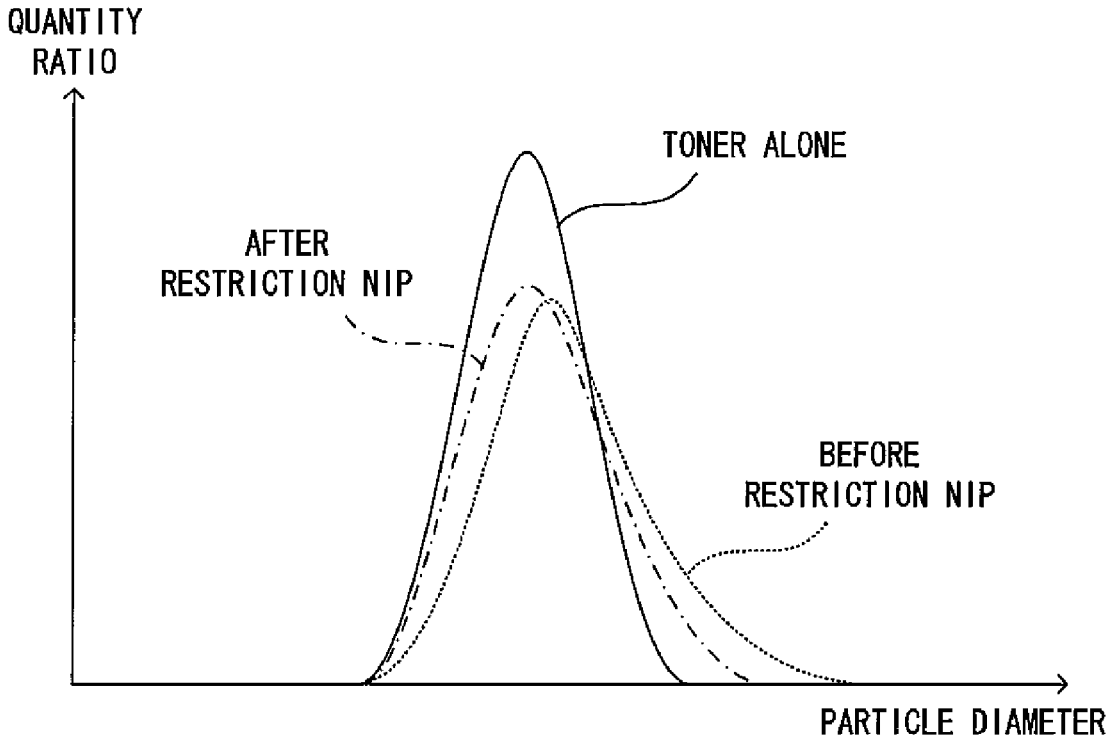
FIG. 11 is a graph showing the toner aggregation crushing effect according to the embodiment.

FIG. 11 is a graph showing the toner aggregation crushing effect according to the embodiment. Toner alone having a particle diameter distribution denoted at the solid line in FIG. 11 was loaded into the image forming apparatus shown in FIG. 1 and the particle diameter distribution of toner carried by the developing roller 44 was measured. The result was that the particle diameter distribution of toner collected from the surface of the developing roller 44 before the restriction nip N1 along the rotation direction of the developing roller 44, i.e., on the upstream side to the restriction nip was as denoted at the dotted-line curve. One can tell from this result that a number of large-diameter particles which toner alone did not include were carried. Flocculation of toner inside the developer and consequent creation of aggregations seems to be the cause. Meanwhile, the particle diameter distribution of toner collected from the surface of the developing roller 44 after the developing roller moved passed the restriction nip N1 was close to the distribution of toner alone in which the proportion of large-diameter particles was smaller than what it was before arrival at the restriction nip and a peak shifted toward the small particle diameter side as denoted at the dashed-dotted line in FIG. 11. It was thus confirmed that the restriction blade 46 according to the embodiment effectively functioned to crush toner aggregations.

Figure 12A:
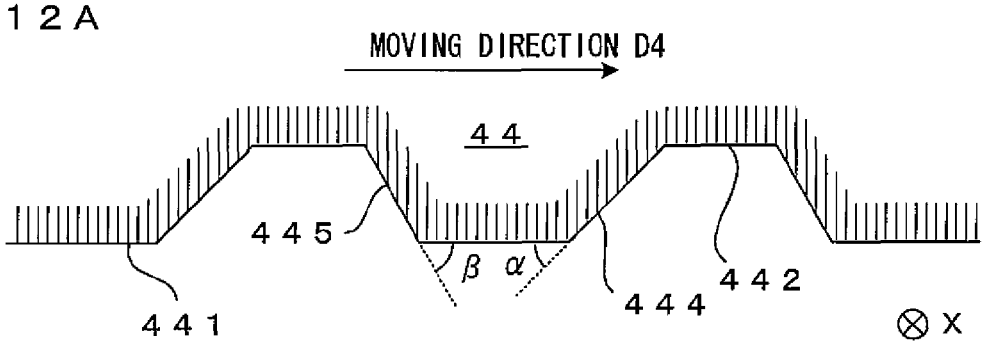
FIGS. 12A, 12B, 12C and 12D are diagrams showing another example of the structure of the surface of the developing roller.

FIGS. 12A, 12B, 12C and 12D are diagrams showing another example of the structure of the surface of the developing roller. Although the convex sections 441 have symmetric shapes with respect to the diagonal lines within their top surfaces in the embodiment above, the shapes of the convex sections 441 may be asymmetric in the circumferential direction. In such an example, the gradient of the slopes connecting the convex sections 441 to the concave sections 442 changes between before and after the convex sections 441 along the rotation direction D4 of the developing roller 44 as shown in FIG. 12A. To be more precise, an angle $\beta$ of the gradient of slopes 445 which are on the rear side of the convex sections 441 along the rotation direction D4, i.e., which arrive at the restriction nip N1 later is greater than an angle $\alpha$ of the gradient of slopes 444 which are on the front side of the convex sections 441, i.e., which arrive at the restriction nip N1 first. This brings about the following advantage.

Figure 12B:
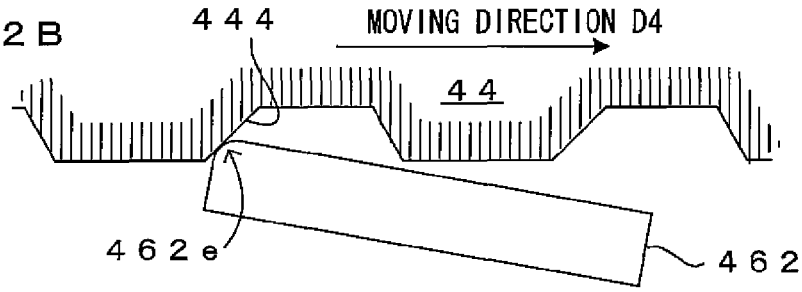
Figure 12C:
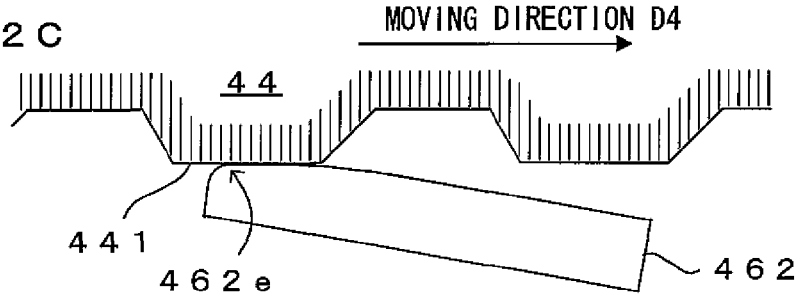

The reason of reducing the gradient of the slopes 444 which are on the front side of the convex sections 441 along the rotation direction D4 will be first described. As shown in FIG. 12B, the edge 462*e* of the elastic member 462 bulging toward the concave sections 442 abuts on the slopes 444, and its front end part gets elastically deformed as if to climb onto the slopes. When the gradient of the slopes is small, the front end of the edge 462*e* is more smoothly guided to the top surfaces of the convex sections 441, thereby preventing the edge 462*e* from colliding the slopes 444 and accordingly getting chipped or serving as large resistance against rotation of the developing roller 44. The elastic member 462 thus climbing onto the convex sections 441 scrapes toner off while sliding on the surfaces of the convex sections 441 and while remaining pressed by the convex sections 441 as shown in FIG. 12C.

Figure 12D:
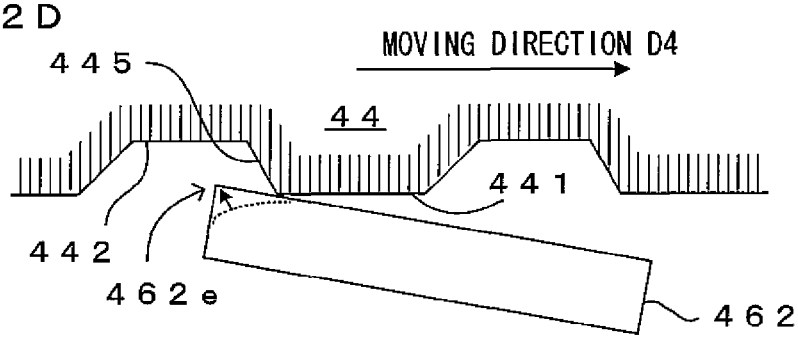

Meanwhile, after moving passed the rear ends of the convex sections 441, the edge 462*e* of the elastic member 462 is freed from pressurization by the convex sections 441 and is going to restore its original shape. As this occurs, in the event that the gradient of slopes 445 which are on the rear side is small, widening of the distance between the convex sections 441 and the elastic member 462 is moderate and the edge 462*e* therefore gradually restores its shape while maintaining its sliding contact with the slopes. On the contrary, when the gradient of slopes 445 which are on the rear side is large and steep, as shown in FIG. 12D, the elastic energy stored at the front end of the elastic member 462 is released all at once and restoration of the original shape happens quickly. This is effective in enlarging the striking force upon toner and enhancing the crushing effect.

As the gradient of the slopes 444 which are on the front side of the convex sections 441 along the rotation direction D4 is set small and the gradient of slopes 445 which are on the rear side is large, it is possible to achieve the crushing effect even better while preventing chipping and the like of the elastic member 462.

The hardness of the elastic member 462 and the abutting pressure upon the developing roller 44 exerted by the restriction blade 46 (restriction load) will now be discussed. If the hardness of the elastic member 462 is excessive, since the elastic member 462 does not get deformed very much and the amount of bulge toward the concave sections 442 is small even when abutting on the developing roller 44, the crushing effect upon toner aggregations is not obtained. While an increased restriction load enhances the crushing effect, this is not desirable as larger drive torque becomes necessary to rotate the developing roller 44 and damage upon toner grows. Particularly when the diameter of toner needs be reduced or the melting point of toner needs be lowered in order to decrease a fixing temperature, it is practically impossible to increase the abutting pressure upon the developing roller 44. This is because application of high pressure upon such toner makes it easy for the toner to aggregate and fixedly adhere.

On the contrary, when the hardness of the elastic member 462 is too low, bulging toward the concave sections 442 due to pressure contact with the developing roller 44 grows and the concave sections 442 may get completely clogged in an extreme instance. This makes favorable transportation of toner impossible. While improvement of this is possible when the restriction load is reduced, lessened vibration of the edge reduces the crushing effect upon toner aggregations. The amount of bulging of the edge depends upon the pitch at which the convex sections 441 are arranged (denoted at the symbol L5 in FIG. 6B), Experiments were conducted to identify a preferable combination of these values. FIG. 13 shows the result.

FIG. 13 is a table showing combinations of the hardness of the elastic member, the restriction load and the gap between the convex sections, while varying the combination of the hardness of the elastic member 462, the restriction load and the gap L4 between the convex sections 441, the crushing effect upon toner aggregations by the edge 462*e* of the elastic member 462 was studied. In FIG. 13, the combinations which brought about a favorable crushing effect are denoted at the symbol "○", the combinations which did not make the edge vibrate are denoted at the symbol "31 ", and the combinations which made the edge 462*e* clog the concave sections 442 are denoted at the symbol "×". As shown in FIG. 13, combinations of a highly hard elastic member and a low restriction load did not make the edge vibrate, and combinations of an elastic member having low hardness and a high restriction load resulted in clogging of the concave sections. While a combination of a highly hard elastic member and a high restriction load or an elastic member having low hardness and a low restriction load is preferable in terms of crushing toner aggregations, a combination of "an elastic member having low hardness and a low restriction load" is the most preferable to meet a demand which has increasing particularly over the recent years for toner having a small particles diameter and a low melting point.

Judging from a comprehensive point of view, as for a preferable combination of the hardness of the elastic member and the restriction load, whichever value the gap between the convex sections has, it is desirable that the hardness of the elastic member is from 65 to 80 degrees in accordance with the JIS-A hardness criterion and the restriction load is from 0.5 to 1.5 g f/mm (i.e., within the ranges enclosed by the thick lines in FIG. 13). A combination falling under these ranges makes the edge of the elastic member vibrate properly and accordingly realizes crushing of toner aggregations without scraping off of toner from the concave sections.

As described above, in this embodiment, the edge 462*e* of the elastic member 462 disposed in the restriction blade 46 abuts on the surface of the developing roller 44 so that the areas within the edge 462*e* abutting upon the convex sections 441 within the surface of the developing roller 44 are elastically deformed and the areas opposed against the concave sections 442 bulge toward the concave sections 442. As the developing roller 44 rotates in this condition, toner is removed from the convex sections 441 and excessive pressure upon toner is prevented. This suppresses creation of toner aggregations. Further, as the edge 462*e* vibrates as if to wave while repeating elastic deformation and restoration, toner aggregations if any are destroyed. It is therefore possible in this embodiment to prevent creation of toner aggregations from causing leakage or scattering of toner from the developer, fog, filming, etc.

While the particle diameter of the toner used in the above embodiment is not particularly limited, a significant effect can be obtained particularly when a toner of a small particle diameter is used. The term "toner of a small particle diameter" as used herein means one having a volume average particle diameter of about 5 μm or less, for example. As the particle diameter of toner decreases, van der Waals' force which acts upon toner increases, and this tendency is particularly notable when the particle diameter of toner is 5 μm or less. Such toner has a very high possibility of adhering to the developing roller 44 and the seal member 47 or of clumping together of toner with each other due to the van der Waals' force. In the apparatus using such toner, the above-described structure makes it possible to effectively prevent the problems such as the toner fixing to the seal member 47 or to the developing roller 44, and the image defects resulting from the toner fixing.

As described above, in the embodiment above, the photosensitive member 22 and the developing roller 44 function as "the image carrier" and "the toner carrier roller" of the invention, respectively Meanwhile, the restriction blade 46 functions as "restriction member" of the invention and the elastic member 462 functions as "the elastic abutting member" of the invention. Within the edge 462*e* of the elastic member 462, those areas abutting on the convex sections 441 of the developing roller 44, e.g., the positions Pc shown in FIG. 9B correspond to "the abutting segments" of the invention, whereas those areas isolated from the surface of the developing roller 44, e.g., the positions Pa shown in FIG. 9B correspond to "the opening segments" of the invention.

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting. The convex sections may be shaped differently such as circles and triangles for instance.

Further, although the embodiment above requires arranging the plurality of convex sections 441 approximately equidistantly on the surface of the developing roller 44 along the width direction X of the developing roller, the convex sections may be arranged at a predetermined offset angle with respect to the width direction X (The embodiment above is related to an example where the offset angle is zero.). Such an arrangement makes the edge 462*e* of the elastic member 462 wave in a more complex manner and enhances the crushing effect. In addition, as the positions within the edge 462*e* at which the edge initially abuts on the convex sections keep changing, it is possible to suppress chipping, local wear and the like of the elastic member 462. For the same reason, the angle θ (FIG. 6B) of the arrangement of the convex sections 441 along an angled direction with respect to the width direction X may be other than 45 degrees.

Although the developing roller 44 is metallic cylinder in the above embodiments, the invention is also applicable to an apparatus comprising a developing roller made of other material. However, experiments performed by the inventors of the invention have identified that the effect of applying the invention was remarkable when a developing roller whose surface is made of a conductive material such as a metallic developing roller and a developing roller made of non-metal with metal-plating thereon is used. In this respect, the invention is also effective to an apparatus comprising a developing roller which is made conductive by dispersing a conductive material such as carbon black or metallic fine powder in a cylinder made of rubber, resin or the like for instance.

Further, although the restriction blade 46 is prepared by attaching the elastic member 462 made of resin to a plate-like member 461 made of metal in the embodiment above, this structure is not limiting. The restriction blade may be a metal plate coated with resin, for example. In addition, since it is not necessary that the blade is conductive, the whole of a restriction blade may be made of resin.

The image forming apparatus in the above embodiment is a color image forming apparatus in which the developers 4K, . . . are attached to the rotary developer unit 4. However, the application of the invention is not limited to this as mentioned earlier. The invention is also applicable to a so-called tandem type color image forming apparatus in which a plurality of developers are arranged along an intermediate transfer belt, and to a monochromatic image forming apparatus which includes only one developer and forms a monochromatic image for example.

As for the toner carrier roller in the invention, it is preferable that the top surfaces of the convex sections form a part of the same cylindrical surface, that is, the enveloping surface formed by the top surfaces of the convex sections is one cylindrical surface. With such a structure, since the toner carrier roller can be regarded as a rotating cylinder in broad perspective, it is possible to maintain the abutting pressure of this cylinder on the restriction member constant in the circumferential direction of the cylinder. This structure enables to remove toner at the convex sections with the elastic abutting member without fail and realize a constant and uniform transported toner amount.

Further, it is preferable that the positions of the abutting segments and the opening segments along the width direction change as the toner carrier roller rotates. This makes the edge part of the elastic abutting member vibrate in a complex vibration mode including waving in accordance with rotation of the toner carrier roller. The crushing effect upon toner aggregations accordingly further improves.

For instance, within the surface of the toner carrier roller, a plurality of convex section rows, which are constituted by the plurality of convex sections which are lined up on a line along the width direction, may be provided along the circumferential direction and between adjacent convex section rows, the positions of the convex sections along the width direction may be different from each other. Alternatively, within the surface of the toner carrier roller, a plurality of convex section rows, which are constituted by the plurality of convex sections which are lined up on a line along a direction which is at a predetermined offset angle with respect to the width direction, may be provided along the circumferential direction. This makes the edge part and the convex sections abut on each other in a complex mode, whereby the edge part vibrates in a complex vibration mode and a high crushing effect is attained.

Further, it is preferable that the gap between the opening segments within the edge part and the concave sections is equal to or larger than the volume average particle diameter of toner. This makes it possible for the concave sections to carry toner having an average particle diameter without application of excessive pressing force upon toner. When the gap between the opening segments within the edge part and the concave sections is equal to or larger than the maximum particle diameter of toner, it is possible for the concave sections to carry even such toner which has the largest diameter in the particle diameter distribution of the toner. This solves a problem that only toner having a large particle diameter is left unused. The maximum particle diameter of toner can be defined for instance as a value which is calculated by adding triple the geometrical standard deviation to the 50% particle diameter at the quantity standard in the particle diameter distribution of the toner. This makes it possible for the concave sections to carry almost all (approximately 99.7% of) toner particles.

Further, it is preferable that the amount of bulging of the edge part in the opening segments is equal to or smaller than the volume average particle diameter of toner. This prevents the edge part from scraping off toner which is carried by the concave sections, and a controlled amount of bulging makes it possible to prevent application of excessive pressing force upon toner which is carried by the concave sections.

With respect to the toner carrier roller, it is preferable that a normal line to the side surface parts which connect the convex sections to the concave sections contains a component which is along a direction away from the rotation shaft of the toner carrier roller. In short, it is preferable that the convex sections and the concave sections are connected to each other by moderate slopes. While this feeds the convex sections one after another to abutting zones with the elastic abutting member and makes the convex sections slide on the edge part during their contact with the edge part as the toner carrier roller rotates, since the surfaces which connect the convex sections to the concave sections are moderate slopes, the edge part will not get stuck at the side surfaces of the convex sections and the drive torque of the toner carrier roller will therefore be small. In addition, it is possible to prevent permanent deformation, chipping and the like of the edge part at those areas of the edge part which abut on the convex sections first.

In this instance, it is preferable that the gradient of the side surface parts is steeper on the rear side to the convex sections rather than on the front side to the convex sections along the rotation direction of the toner carrier roller. Since this makes the edge part abut on the moderate slopes and elastically deforms the edge part gradually on the front-end side of the convex sections which moves toward the edge part in accordance with rotation of the toner carrier roller while mitigating deformation on rear-end side of the convex sections at once in a short period of time, the striking force upon toner increases further and the crushing effect upon toner aggregations enhances.

The amplitude of vibration of the edge part is related closely to the hardness of the elastic abutting member and the abutting pressure with which the elastic abutting member abuts on the toner carrier roller. That is, bulging toward the concave sections decreases and the amplitude of vibration decreases when the hardness of the elastic abutting member is too large, whereas the hardness is too small, the elastic abutting member excessively bulges into inside the concave sections and presses toner or scrapes toner off. Meanwhile, when the abutting pressure is large, the pressing force upon toner increases and toner is damaged significantly. This becomes a particularly serious problem in the event that toner having a small particle diameter or a low melting point is used, and therefore, the abutting pressure should be small. According to experiments performed by the inventors of the invention, a sufficient toner aggregation crushing effect was achieved without causing such a problem when the hardness of the elastic abutting member was from 65 to 80 degrees in accordance with the JIS-A hardness criterion and the abutting pressure upon the toner carrier roller was from 0.5 to 1.5 g f/mm.

The invention brings about a particularly remarkable effect when the volume average particle diameter of toner is 5 μm or less. With respect to toner having such a small particle diameter, the toner tends to aggregate as van der Waals' force which acts among toner particles is strong. Further, since an additive for enhancing the fluidity of toner as well has a small diameter and can easily drop off from core toner particles, the fluidity tends to decrease with time. This can easily give rise to clusters of toner. The invention, when applied to an apparatus which uses such toner, effectively solves various problems which are attributable to creation of clusters of toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a toner carrier roller which rotates while carrying a toner layer of charged toner on its surface, the toner carrier being shaped approximately like a cylinder and being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections; and a restriction member which abuts on the surface of the toner carrier roller, the restriction member removing toner from the convex sections of the toner carrier roller such that the concave sections alone carry toner, thereby restricting the toner layers which are carried on the surface of the toner carrier roller, the restriction member including an elastic abutting member formed by an elastic material, the elastic abutting member which includes an edge part which extends along the width direction parallel to the rotation shaft of the toner carrier roller and abuts on the surface of the toner carrier roller, wherein within a restriction nip which is created as the toner carrier roller and the restriction member abut on each other, a plurality of abutting segments where the edge part abuts on the plurality of convex sections, and a plurality of opening segments where the edge part and the concave sections are opposed to each other with a gap between each other, appear alternatingly along the width direction, and in the opening segments, the edge part of the elastic abutting member bulges toward bottom surfaces of the concave sections beyond linear lines which connect top surfaces of two adjacent convex sections which are on both sides to the concave sections which are opposed to the edge part, and the gap between the edge part at the opening segments and the concave sections is equal to or larger than the volume average particle diameter of toner.

2. The developer apparatus of claim 1, wherein the convex sections are so constructed and arranged that top surfaces of the convex sections coincide with a part of a curved surface of a single cylinder.

3. The developer apparatus of claim 1, wherein positions of the abutting segments and the opening segments along the width direction change as the toner carrier roller rotates.

4. The developer apparatus of claim 1, wherein a plurality of convex section rows, which are constituted by the plurality of convex sections which are lined up on a line along the width direction, are provided along the circumferential direction within the surface of the toner carrier roller, and between adjacent convex section rows, the positions of the convex sections along the width direction are different from each other.

5. The developer apparatus of claim 1, wherein a plurality of convex section rows, which are constituted by the plurality of convex sections which are lined up on a line along a direction which is at a predetermined offset angle with respect to the width direction, are provided along the circumferential direction within the surface of the toner carrier roller.

6. The developer apparatus of claim 1, wherein the gap between the edge part at the opening segments and the concave sections is equal to or larger than the maximum particle diameter of toner.

7. The developer apparatus of claim 1, wherein the amount of bulging of the edge part at the opening segments is equal to or smaller than the volume average particle diameter of toner.

8. The developer apparatus of claim 1, wherein a normal line to side surface parts which connect the convex sections to the concave sections contains a component which is along a direction away from the rotation shaft of the toner carrier roller.

9. The developer apparatus of claim 8, wherein a gradient of the side surface parts is steeper on a rear side to the convex sections rather than on a front side to the convex sections along the rotation direction of the toner carrier roller.

10. The developer apparatus of claim 1, wherein the hardness of the elastic abutting member is from 65 to 80 degrees in accordance with the JIS-A hardness criterion and the abutting pressure by the elastic abutting member upon the toner carrier roller is from 0.5 to 1.5 g f/mm.

11. The developer apparatus of claim 1, wherein a volume average particle diameter of toner is 5 μm or smaller.

12. An image forming apparatus, comprising:

an image carrier which carries an electrostatic latent image;

a toner carrier roller which is opposed to the image carrier and rotates while carrying a toner layer of charged toner on its surface, the toner carrier being shaped approximately like a cylinder and being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections; and a restriction member which abuts on the surface of the toner carrier roller, the restriction member removing toner from the convex sections of the toner carrier roller such that the concave sections alone carry toner, thereby restricting the toner layers which are carried on the surface of the toner carrier roller, the restriction member including an elastic abutting member formed by an elastic material, the elastic abutting member which includes an edge part which extends along the width direction parallel to the rotation shaft of the toner carrier roller and abuts on the surface of the toner carrier roller, wherein within a restriction nip which is created as the toner carrier roller and the restriction member abut on each other, a plurality of abutting segments where the edge part abuts on the plurality of convex sections, and a plurality of opening segments where the edge part and the concave sections are opposed to each other with a gap between each other, appear alternatingly along the width direction, and in the opening segments, the edge part of the elastic abutting member bulges toward bottom surfaces of the concave sections beyond linear lines which connect top surfaces of two adjacent convex sections which are on both sides to the concave sections which are opposed to the edge part, and the gap between the edge part at the opening segments and the concave sections is equal to or larger than the volume average particle diameter of toner.

13. An image forming method comprising:

arranging a toner carrier roller oppositely to an image carrier which carries an electrostatic latent image, the toner carrier roller being provided, on a surface thereof, with a plurality of convex sections, which are regularly arranged along a width direction parallel to a rotation shaft of the toner carrier roller and a circumferential direction which is along a circumferential surface of the toner carrier roller, and concave sections which surround the convex sections, and rotating while carrying on its surface a toner layer of charged toner;

abutting a restriction member which includes an elastic abutting member formed by an elastic material, the restriction member removing toner from the convex sections of the toner carrier roller such that the concave sections alone carry toner, thereby restricting the toner layers which are carried on the surface of the toner carrier roller, the elastic abutting member including an edge part which extends along the width direction parallel to the rotation shaft of the toner carrier roller and abuts on the surface of the toner carrier roller; and developing the electrostatic image with the toner carried on the toner carrier roller, wherein a plurality of abutting segments where the edge part abuts on the plurality of convex sections, and a plurality of opening segments where the edge part and the concave sections are opposed to each other with a gap between each other, appear alternatingly along the width direction, and at the opening segments, the edge part of the elastic abutting member bulges toward bottom surfaces of the concave sections beyond linear lines which connect top surfaces of two adjacent convex sections which are on both sides to the concave sections which are opposed to the edge part, and the gap between the edge part at the opening segments and the concave sections is equal to or larger than the volume average particle diameter of toner.

* * * * *